United States Patent [19]

Barten et al.

[11] 4,220,897

[45] Sep. 2, 1980

[54] METHOD OF MANUFACTURING A COLOR DISPLAY TUBE AND COLOR DISPLAY TUBE MANUFACTURED ACCORDING TO SAID METHOD

[75] Inventors: Piet G. J. Barten; Jan Gerritsen; Kees Tendeloo, all of Eindhoven, Netherlands

[73] Assignee: U.S. Philips Corporation, New York, N.Y.

[21] Appl. No.: 907,897

[22] Filed: May 19, 1978

[30] Foreign Application Priority Data

Jul. 6, 1977 [NL] Netherlands ..... 7707476

[51] Int. Cl.[2] ..... H01J 29/70; H01J 29/76

[52] U.S. Cl. ..... 315/368

[58] Field of Search ..... 315/368, 13 C

[56] References Cited

U.S. PATENT DOCUMENTS 4,125,795 11/1978 Ikebata et al. ..... 315/368

*Primary Examiner*—Theodore M. Blum

*Attorney, Agent, or Firm*—Thomas A. Briody; William J. Streeter; Edward W. Goodman

[57] ABSTRACT

A ring is provided to correct the convergence, color purity and frame errors of a color display tube which ring is magnetized as a multipole and which is secured in or around the tube neck and around the paths of the electron beams.

The magnetization of such a ring can best be carried out by energizing a magnetization unit with a combination of direct currents thereby generating a multipole magnetic field and then effecting the magnetization by generating a decaying alternating magnetic field which preferably varies its direction continuously.

7 Claims, 18 Drawing Figures

METHOD OF MANUFACTURING A COLOR DISPLAY TUBE AND COLOR DISPLAY TUBE MANUFACTURED ACCORDING TO SAID METHOD

BACKGROUND OF THE INVENTION

The invention relates to a method of manufacturing a color display tube in which magnetic poles are provided in or around the neck of the envelope and around the paths of the electron beams, which poles generate a permanent multipole magnetic field for the correction of the occurring errors in convergence, color purity and frame of the color display tube, which magnetic poles are formed by the magnetisation of a configuration of magnetisable material provided around the paths of the electron beams, which configuration is magnetized by energising a magnetising device with a combination of currents with which a static multipole magnetic field is generated.

The invention also relates to a color display tube manufactured according to said method.

In a color display tube of the "delta" type, three electron guns are accommodated in the neck of the tube in a triangular arrangement. The points of intersection of the axes of the guns with a plane perpendicular to the tube axis constitute the corner points of an equilateral triangle.

In a color display tube of the "in-line" type three electron guns are arranged in the tube neck in such manner that the axes of the three guns are situated mainly in one plane while the axis of the central electron gun coincides substantially with the axis of the display tube. The two outermost electron guns are situated symmetrically with respect to the central gun. As long as the electron beams generated by the electron guns are not deflected, the three electron beams, both in tubes of the "delta" type and of the "in-line" type, must coincide in the center of the display screen (static convergence). Because, however, as a result of defects in the manufacture of the display tube, for example, the electron guns are not sealed quite symmetrically with respect to the tube axis, deviations of the frame shape, the color purity and the static convergence occur. It should be possible to correct said deviations.

Such a color display tube of the "in-line" type in which this correction is possible, is disclosed in Netherlands Pat. application No. 7,503,830 laid open to public inspection. Said application describes a color display tube in which the deviations are corrected by the magnetisation of a ring of magnetisable material, as a result of which a static magnetic multipole is formed around the paths of the electron beams. Said ring is provided in or around the tube neck. In the method described in said patent application, the color display tube is actuated after which data, regarding the value and the direction of the convergence errors of the electron guns, are established, with reference to which the polarity and strength of the magnetic multipole necessary to correct the frame, color purity and convergence errors are determined. The magnetisation of the configuration, which may consist of a ring, a ribbon or a number of rods or blocks grouped around the electron paths, may be carried out in a number of manners. It is possible, for example, first to magnetise the configuration to full saturation, after which demagnetisation to the desired value is carried out with an opposite field. A disadvantage of this method is that, with a combination of, for example, a 2, 4, and 6-pole field, the polarity and strength of the demagnetisation vary greatly and frequently, dependent on the place on the ring, and hence also the polarity and strength of the full magnetisation used in this method. Moreover it appears that the required demagnetising field has no linear relationship with the required correction field. Due to this non-linearity it is not possible to use a combined 2, 4 and 6-pole field for the demagnetisation. It is impossible to successively carry out the 2, 4 and 6-pole magnetisation since, for each magnetisation, the ring has to be magnetised fully, which results in the preceding magnetisation being erased again. The possibility of successively magnetising various places on the ring is very complicated and is not readily possible if the ring is situated in the tube neck since the stray field of the field necessary for the magnetisation again demagnetizes, at least partly, the already magnetised places.

SUMMARY OF THE INVENTION

It is therefore an object of the invention to provide a method with which a combined multipole can be obtained by one total magnetisation.

According to the invention, a method, of the kind described in the first paragraph with which this is possible, is characterized in that the magnetisation is effected by means of a decaying alternating magnetic field which initially drives the magnetisable material on either side of the hysteresis curve into saturation. After the decay of the alternating magnetic field, a hard magnetisation remains in the material of the configuration which neutralizes the externally applied magnetic field and is, hence, directed oppositely thereto. After switching off the externally applied magnetic field, a magnetic multipole field remains as a result of the configuration magnetized as a multipole. The desired magnetisation may be determined in a number of manners. By observing and/or measuring the deviations in the frame shape, color purity and convergence, the desired multipole can be determined experimentally and the correction may be carried out by magnetisation of the configuration. If small deviations are then still found, the method is repeated once or several times with corrected currents. In this manner, by repeating the method according to the invention, it is possible to produce a complete correction of the errors in frame, color purity and convergence. Preceding the magnetisation, residual magnetism, if any, in the configuration is preferably erased by means of a magnetic field.

The method is preferably carried out by determining the required correction field prior to the magnetisation and, after the erasing of the residual magnetism, by correcting the errors in the convergence, the color purity and the frame of the displayed picture by means of a combination of currents through the magnetising device, after which the magnetisation is produced by reversing the direction of the combination of currents, increasing the current strength and simultaneously producing the said decaying alternating magnetic field.

The correction field, obtained with the magnetizing device and measured along the axis of the electron beams, is generally longer than the multipole correction field generated by the configuration. So the correction of the deviations will have to be carried out over a shorter distance along the axis of the tube, which is possible only with a stronger field. During the magnetisation, a combination of currents, which in strength and direction is in the proportion of m:1 to the combination of currents which is necessary to generate a correction multipole field with the device, where m is, for example, −3, should flow through the magnetisation device. The value of m depends on the ratio between the length of the correction multipole field, generated by the magnetizing device, to the effective field length of the magnetized configuration. This depends upon a number of factors, for example, the diameter of the neck, the kind of material, the shape and the place of the configuration, etc., and can be established experimentally. If it proves, upon checking, that the corrections with the magnetized configuration are too large or too small, the magnetisation process can be repeated with varied magnetisation currents.

The decaying alternating magnetic field can be generated by superimposing a decaying alternating current on the combination of currents through the magnetisation device (for example, a device as disclosed in Netherlands Pat. application No. 7,503,830 laid open to public inspection). The decaying alternating magnetic field is preferably generated in the magnetisation device by means of a separate system of coils. In order to obtain a substantially equal influence of all parts of the configuration by the decaying alternating field, it is recommendable not only to cause the alternating field to decay but also to cause it to vary its direction continuously. The system of coils therefore consists preferably of at least two coils and the decaying alternating currents through the coils are shifted in phase with respect to each other. Standard line frequency (50 or 60 Hz) has proven to give good results. The phase shift, when using coils or coil pairs, the axes of which enclose angles of 120° with each other, can simply be obtained from a three-phase line.

DESCRIPTION OF THE DRAWINGS

The invention will now be described in greater detail with reference to a drawing, in which.

DESCRIPTION OF THE PREFERRED EMBODIMENTS

Figure 1:
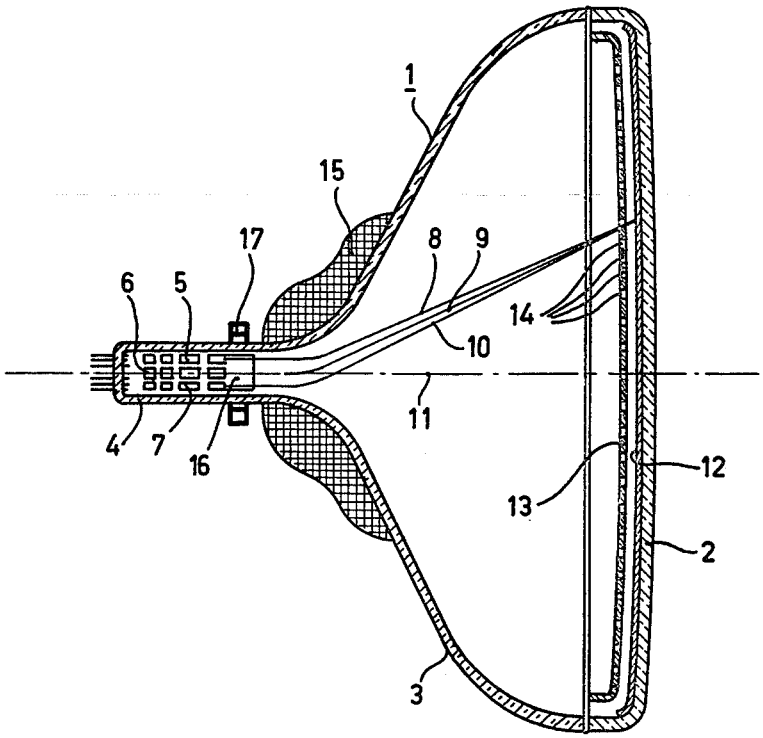
FIG. 1 is a diagrammatic sectional view of a known color display tube of the "in-line" type having an external static convergence unit.

FIG. 1 is a diagrammatic sectional view of a known color display tube of the "in-line" type. Three electron guns 5, 6 and 7, generating the electron beams 8, 9 and 10, respectively, are accommodated in the neck 4 of a glass envelope 1 which is composed of a display window 2, a funnel-shaped part 3 and a neck 4. The axes of the electron guns 5, 6 and 7 are situated in one plane, the plane of the drawing. The axis of the central electron gun 6 coincides substantially with the tube axis 11. The three electron guns are seated in a sleeve 16 which is situated coaxially in the neck 4. The display window 2 has on the inner surface thereof a large number of triplets of phosphor lines. Each triplet comprises a line of a phosphor luminescing green, a line of a phosphor luminescing blue, and a line of a phosphor luminescing red. All of the triplets together constitute a display screen 12. The phosphor lines are normal to the plane of the drawing. A shadow mask 12, in which a very large number of elongate apertures 14 are provided through which the electron beams 8, 9 and 10 pass, is arranged in front of the display screen 12. The electron beams 8, 9 and 10 are deflected in the horizontal direction (in the plane of the drawing) and in the vertical direction (at right angles thereto) by a system 15 of deflection coils. The three electron guns 5, 6 and 7 are assembled so that the axes thereof enclose a small angle with respect to each other. As a result of this, the generated electron beams 8, 9 and 10 pass through each of the apertures 14 at said angle, the so-called color selection angle, and each impinge only upon phosphor lines of one color.

Figure 2:
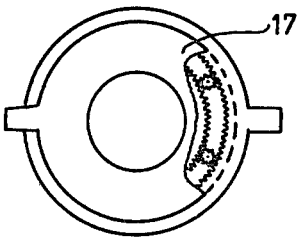
FIG. 2 shows the pinion transmission used therein.

A display tube has a good static convergence if the three electron beams, when they are not being deflected, intersect each other substantially in the center of the display screen. It has been found, however, that the static convergence often is not good, no more than the frame shape and the color purity, which may be the result of an insufficiently accurate assembly of the guns, and/or sealing of the electron guns, in the tube neck. In order to produce the static convergence, so far, externally adjustable correction units have been added to the tube. They consist of a number of pairs of multipoles consisting of magnetic rings, for example four two-poles (two horizontal and two vertical), two four-poles and two six-poles. The rings of each pair are coupled together by means of a pinion transmission (see FIG. 2), with which the rings are rotatable with respect to each other to an equal extent. By rotating the rings with respect to each other and/or together, the strength and/or direction of the two-, four- or six-pole field is adjusted. It will be obvious that the control of a display tube with such a device is complicated and time-consuming. Moreover, such a correction unit is material-consuming since, for a combination of multipoles, at least eight rings are necessary which have to be provided around the neck so as to be rotatable with respect to each other.

In the Netherlands Pat. application No. 7,503,830, laid open to public inspection, the complicated correction unit has, therefore, been replaced by one or more magnetized rings, which rings are situated in or around the tube neck or in or around the electron guns.

However, it has proved difficult with the magnetising methods known so far to provide a combination of multipoles in the ring by magnetisation.

The method according to the invention provides a solution.

For clarity, identical components in the following figures will be referred to by the same reference numerals as in FIG. 1.

Figure 3:
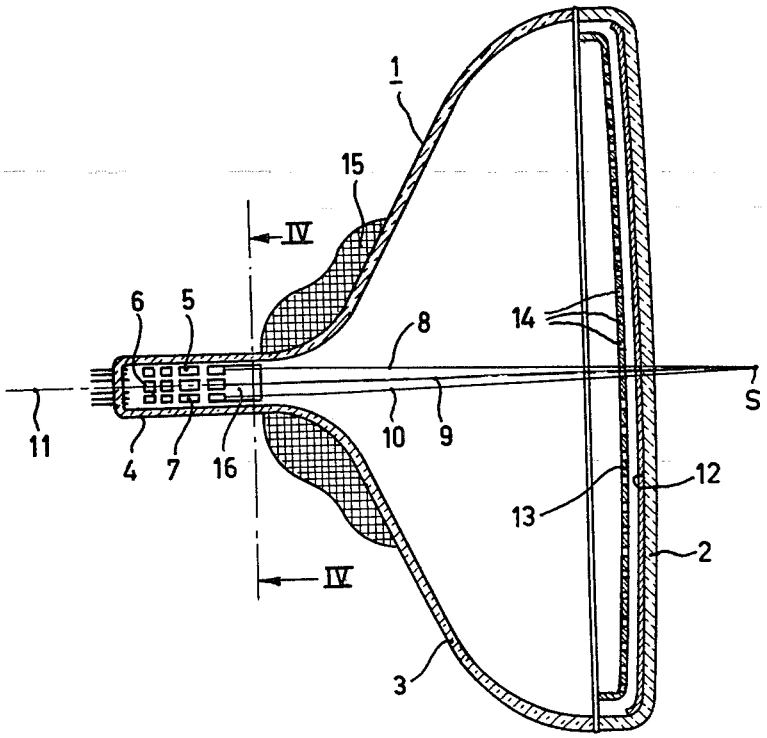
FIGS. 3 and 4 are two diagrammatic perpendicular cross-sectional views of the color display tube with a ring, which has not yet been magnetized, and in which the outermost electron beams do not converge satisfactorily.

FIG. 3 is a diagrammatic sectional view of a display tube in which the electron beams do not converge in the horizontal direction. As is known, the outermost electron beams can be deflected more or less in the opposite direction by means of a four-pole, for example, towards the central beam or away therefrom. It is also possible to move the beams upwards and downwards. By means of a six-pole the beams can be deflected more or less in the same direction. For simplicity, the invention will be described with reference to a display tube which requires only a four-pole correction. The convergence errors in the horizontal direction of the electron beams 8 and 10 are in this case equally large but opposite.

Figure 4:
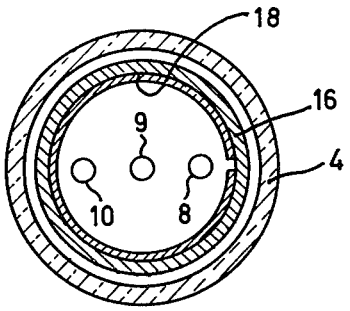

FIG. 4 is a sectional view of FIG. 3. On the bottom of sleeve 16, a ring 18 is provided of an alloy of Fe, Co, V and Cr (known as Vicalloy) which can be readily magnetized. It will be obvious that the ring may alternatively be provided in other places around the guns or in or around the tube neck. Instead of a ring it is alternatively possible to use a ribbon or a configuration of rods or blocks of magnetisable material.

Figure 5:
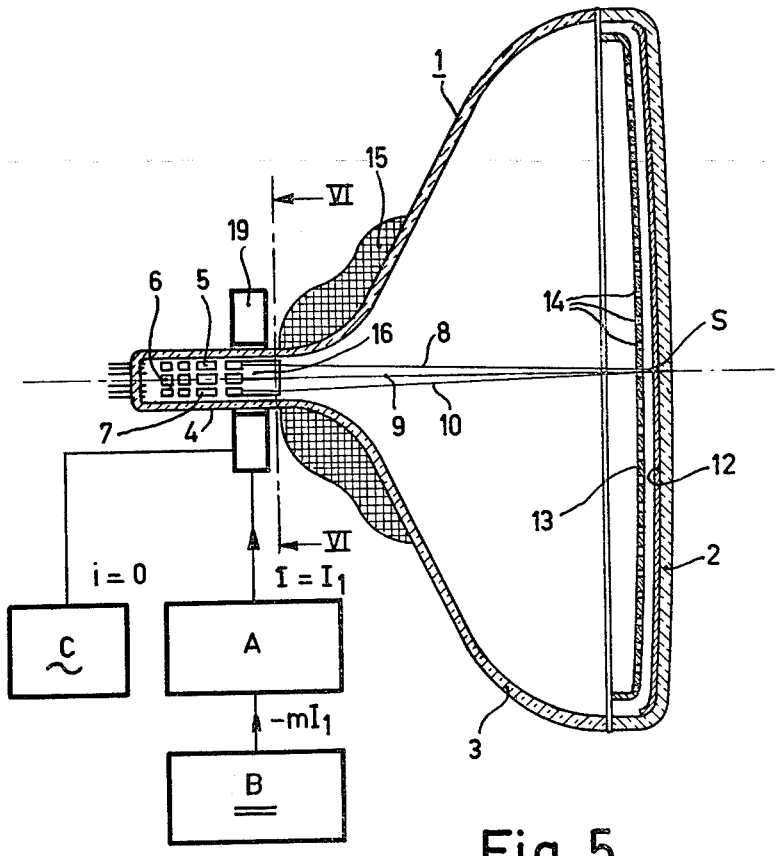
FIGS. 5 and 6 are two diagrammatic perpendicular sectional views of a color display tube in which convergence by means of the magnetisation device has been obtained.

In FIG. 5 a device 19 for generating a controllable multipole magnetic field is provided around the neck 4 and the ring 18 according to the method of the invention. 2-, 4- or 6-poles and combinations thereof can be generated by means of the device 19. For the tube shown in FIG. 3, only a four-pole correction is necessary. The coils of the device 19, which device will be described in detail hereinafter, are in this case energized as four-poles until the point of intersection S of the three electron beams 8, 9 and 10, which in FIG. 3 was situated outside the tube 1, lies on the display screen 12. The current I through the coils of the device originates from a direct current source B which supplies a current $-mI_1$ (m being an experimentally determined constant $>1$) to the coils via a current divider and commutator A. The current can be adjusted per coil so as to generate the desired multipole. In this phase of the method, an alternating current source C does not yet supply current ($i=0$).

Figure 6:
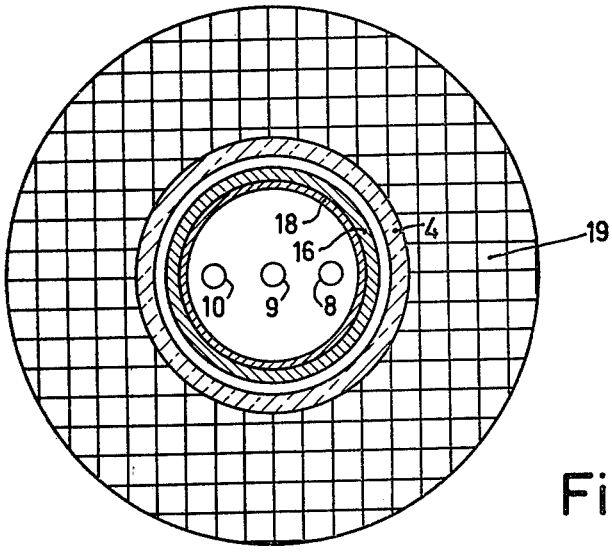

FIG. 6 is a perpendicular sectional view of FIG. 5. The current $I_1$ is a measure of the strength of the required correction field. The correction field of the multipole of the device 19 extends over a larger length of the electron paths than the magnetic field generated later by the magnetized ring. Therefore the field of the ring is to be m-times stronger.

Figure 7:
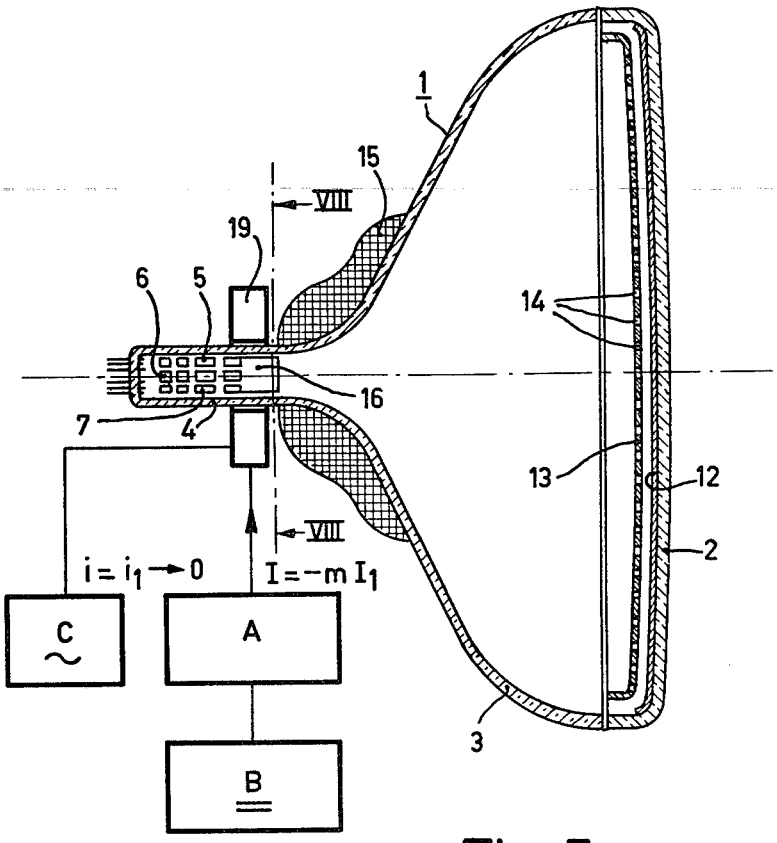
FIGS. 7 and 8 show the magnetisation of a ring arranged in the system of electron guns.
Figure 8:
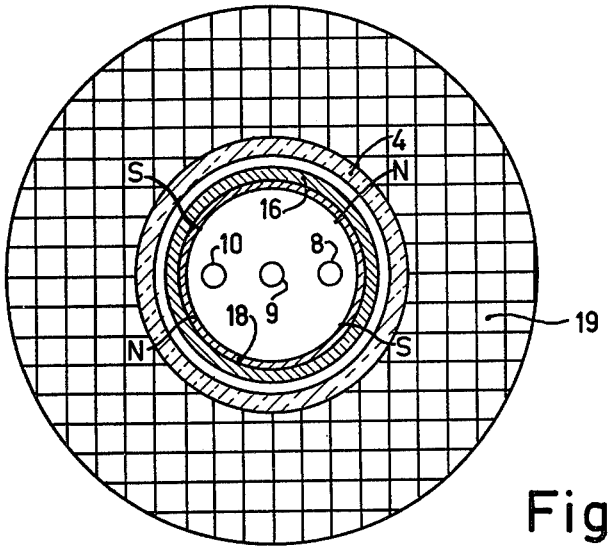

FIG. 7 shows the step of the method in which the ring 18 is magnetized as a four-pole. As follows from the above, in this preferred embodiment of the method, the current through the coils of the device must be $-mI_1$ during the magnetisation, so must traverse in the reverse direction and be m-times as large as the current through the coils during the correction. Moreover, the alternating current source C supplies a decaying alternating current ($i=i_1>0$) to the device 19, with which current the decaying alternating field is generated. When the alternating current is switched on, it must be so large that the ring 18 is fully magnetized on either side of the hysteresis curve. When the alternating field has decayed, the ring 18 is magnetized, in this case as a four-pole. It is, of course, alternatively possible to magnetise the ring 18 as a six-pole or as a two-pole or to provide combinations of said multipoles in the ring 18 and to correct therewith other convergence errors or color purity and frame errors. It is also possible to use said corrections in color display tubes of the "delta" type.

Figure 9:
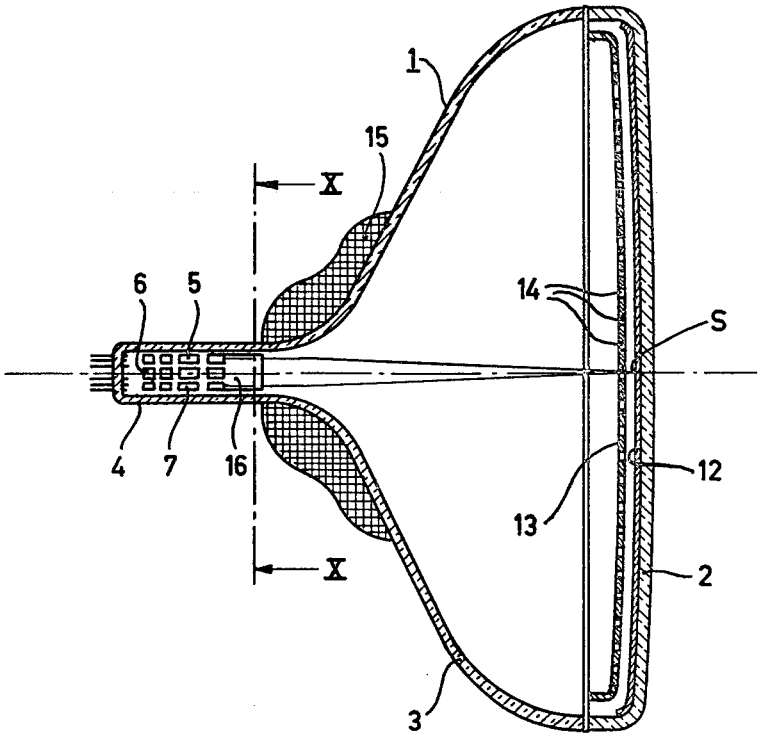
FIGS. 9 and 10 show two diagrammatic perpendicular sectional views of a color display tube with a magnetized ring with which the convergence error, as shown in FIG. 4, is removed.

FIG. 9 shows the display tube 1 shown in FIG. 3, but in this case provided with a ring 18 magnetized according to the method of the invention as shown in FIGS. 5 and 7. The convergence correction takes place only by the magnetized ring 18 present in sleeve 16. The provision of the required multipole takes place at the display tube 1 factory and complicated adjustments and adjustable convergence units (FIG. 2) may be omitted.

Figure 10:
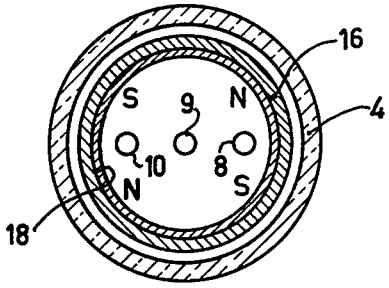
Figure 11:
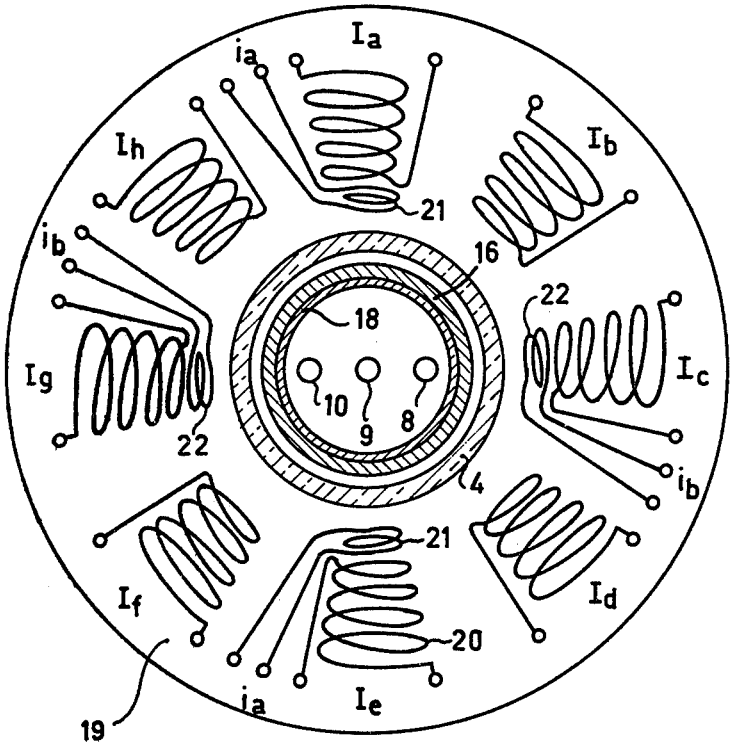
FIGS. 11 and 12 show two types of devices suitable for magnetisation according to the invention.
Figure 12:
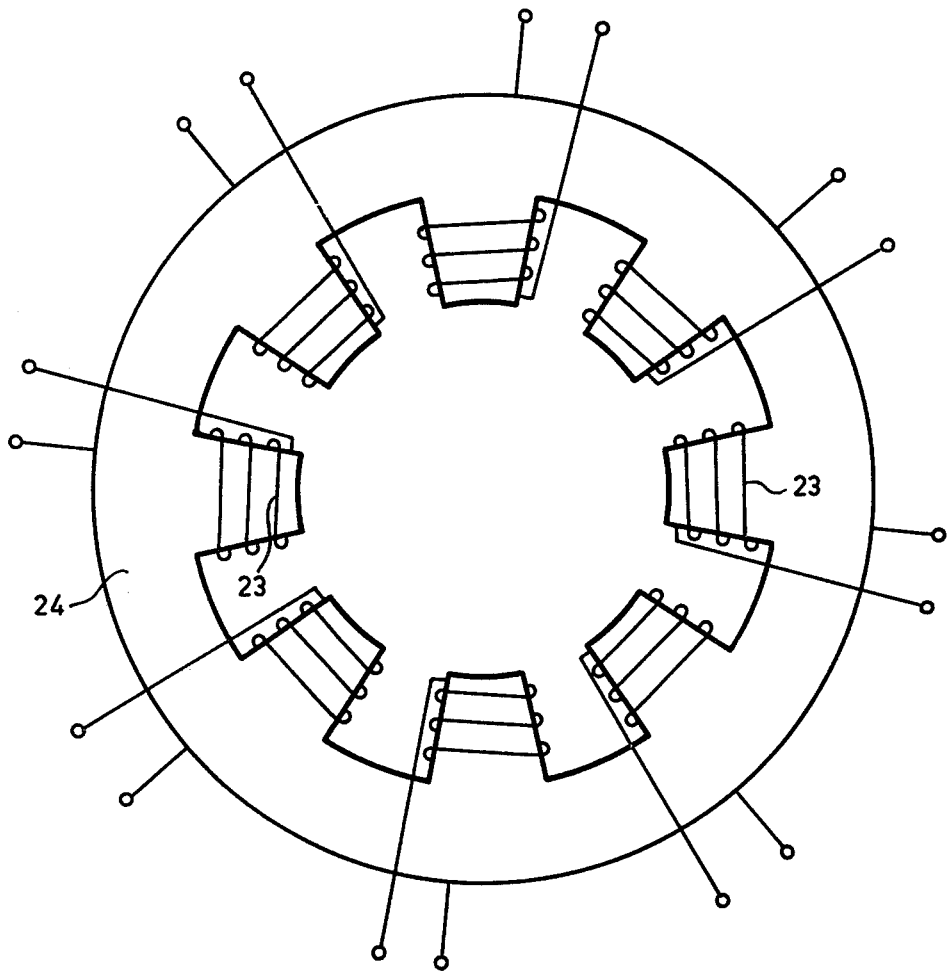

FIG. 10 is a cross-sectional view perpendicular to FIG. 9. FIG. 11 shows a magnetisation device 19 comprising eight coils 20 with which the convergence (see FIG. 5) and the magnetisation (see FIG. 7) are carried out. For generating the decaying alternating magnetic field, two pairs of coils 21 and 22, extending in this case at right angles to each other, are incorporated in the device 19. The current $i_a$ through the pair of coils 21 is shifted in phase through 90° with respect to the current $i_b$ through the other pair of coils 22, so that the decaying alternating magnetic field changes its direction during the decay and is a field circulating through the ring 18. FIG. 12 shows a magnetisation device known from Netherlands Pat. application No. 7,503,830 laid open to public inspection. In this case, the decaying alternating current may be superimposed on the direct current through the coils 23 so that extra coils are not necessary in the device. The coils 23 are wound around a yoke 24.

The magnetisation device 19 may alternatively be composed of a combination of electrical conductors and coils, as is shown diagrammatically in FIGS. 13 to 18.

Figure 13:
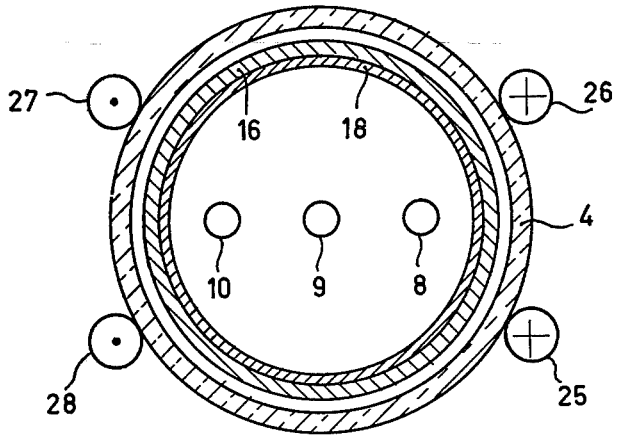
FIGS. 13 to 18 show parts of another type of magnetisation unit.

FIG. 13 is a sectional view of the neck 4 of a display tube 1 at the area of a ring 18 to be magnetised. A two-pole field for corrections in the horizontal direction is generated in this case by causing currents to flow through the conductors 25, 26, 27 and 28 in the direction as shown in the figure. Said conductors may be single wires or wire bundles forming part of one or more coils or turns, and extending parallel to the tube axis at the area of the ring 18.

Figure 14:
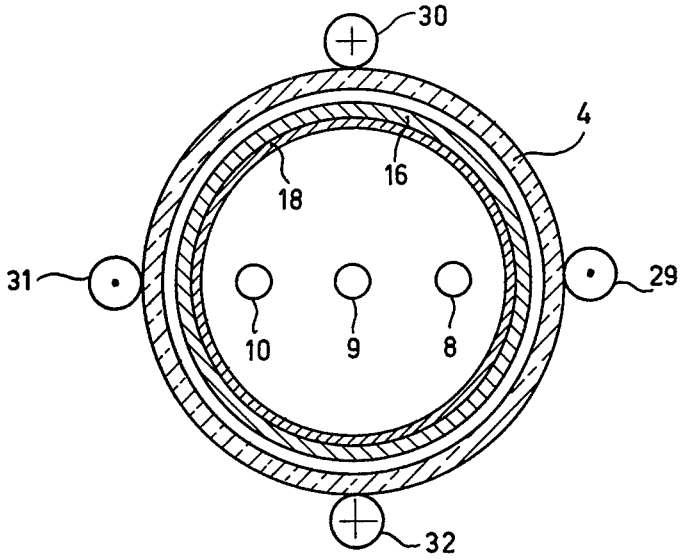

FIG. 14 shows how, in an analogous manner, a four-pole field for corrections of the outermost beams 8 and 10 in the horizontal direction can be generated by electrical conductors 29, 30, 31 and 32. A four-pole field for corrections of the outermost beams 8 and 10 in the vertical direction is substantially the same. However, the system of conductors 29, 30, 31 and 32 is rotated through 45° with respect to the neck 4 and the axis of the tube 1.

Figure 15:
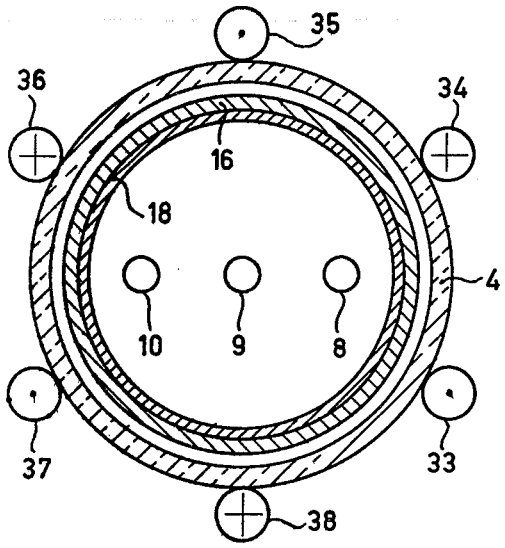

FIG. 15 shows, in an analogous manner, a six-pole for corrections in the horizontal direction with conductors 33 to 38. By means of a combination of conductors (wires or wire bundles) with which 2-, 4- and 6-poles can be generated, all combinations of two-, four- and six-pole fields with the desired strength can be obtained by variations of the currents through said conductors 33 to 38.

Figure 16:
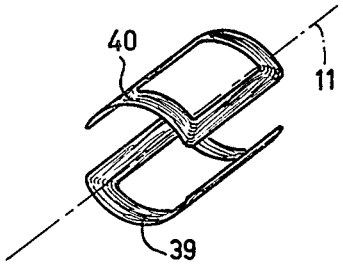
Figure 17:
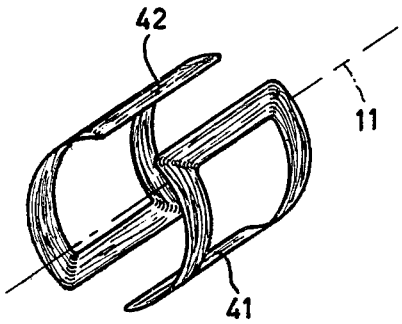
Figure 18:
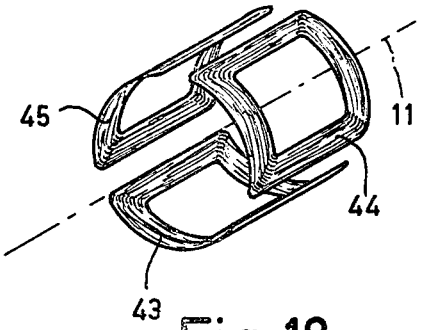

The decaying alternating magnetic field in a magnetisation unit with conductors as shown in FIGS. 13, 14 and 15 can be obtained by means of coils positioned symmetrically around the neck 4 and the conductors as shown in FIGS. 16 and 17 or 18. By energizing the coils 39 and 40, shown in FIG. 16, with a decaying alternating current, a decaying alternating magnetic field is generated. A better influencing of the ring 18 by the decaying alternating field is obtained when a system of coils having coils 41 and 42 in FIG. 17 is provided which is rotated 90° with respect to the coils 39. In this case, 40 and the decaying alternating current through the coils 41 and 42 should then preferably be shifted 90° in phase with respect to the decaying alternating current through the coils 39 and 40.

It is alternatively possible to generate the decaying alternating magnetic field with one or more systems of coils as shown in FIG. 18. The coils 43, 44 and 45 are situated symmetrically around the tube axis and are energized with decaying alternating currents which are shifted 120° in phase with respect to each other (for example from a three-phase line).

What is claimed is:

1. A method of manufacturing a color display tube in which magnetic poles are provided in or around the neck of said tube and around the paths of the electron beams, which poles generate a permanent static multipole magnetic field for the correction of errors in convergence, color purity and frame of the display tube, which magnetic poles are formed by the magnetisation of a configuration of magnetisable material provided around the paths of the electron beams, the method comprising energizing a magnetisation device with a combination of direct currents with which a static multipole magnetic field is generated, and superimposing a decaying alternating magnetic field over said static multipole magnetic field which initially drives said magnetisable material into saturation on either side of the hysteresis curve thereof, said decaying alternating magnetic field being generated by a decaying alternating current.

2. The method as claimed in claim 1, 6 or 7, wherein the decaying alternating magnetic field is generated by means of a separate system of coils in the magnetisation device.

3. The method as claimed in claim 2, wherein the decaying alternating magnetic field varies its direction continuously.

4. The method as claimed in claim 3 wherein the frequency of the decaying alternating current is approximately the standard line frequency.

5. A colour display tube manufactured by means of the method as claimed in claim 4.

6. The method as claimed in claim 1 which further comprises erasing any residual magnetism in said configuration, prior to said magnetisation, with an alternating magnetic field.

7. The method as claimed in claim 6 which further comprises correcting the errors in convergence, color purity and frame of the display picture with a combination of direct currents applied to said magnetisation device and then reversing said direct currents while increasing the magnitudes thereof and applying these adjusted direct currents to said magnetisation device for the magnetisation of said configuration.

* * * * *